US005873216A

United States Patent [19]

Appelbe et al.

[11] Patent Number: 5,873,216

[45] Date of Patent: Feb. 23, 1999

[54] METHOD AND APPARATUS FOR THE PRODUCTION OF TAGGED PACKETS

[75] Inventors: Harvey William Appelbe; Thomas William Bailey; James Goodwin, all of Coventry, United Kingdom

[73] Assignee: Lipton, Division of Conopco, Inc., Englewood Cliffs, N.J.

[21] Appl. No.: 753,620

[22] Filed: Nov. 27, 1996

[30] Foreign Application Priority Data

Dec. 5, 1995 [EP] European Pat. Off. ..... 95308797

[51] Int. Cl.[6] ..... B65B 29/04

[52] U.S. Cl. ..... 53/413; 53/134.2; 493/386; 493/375

[58] Field of Search ..... 53/413, 134.2, 53/451, 551, 552; 493/88, 226, 375, 380, 386

[56] References Cited

U.S. PATENT DOCUMENTS

| | | | |
|---|---|---|---|
| 4,603,536 | 8/1986 | de la Poype | 53/451 X |
| 4,744,202 | 5/1988 | Wylie | 53/451 |
| 5,097,651 | 3/1992 | Decottignies et al. | 53/451 |
| 5,399,224 | 3/1995 | Vernon et al. | 53/134.2 X |
| 5,439,529 | 8/1995 | Vernon et al. | 53/413 X |
| 5,511,359 | 4/1996 | Kenney | 53/413 |
| 5,580,408 | 12/1996 | Vernon et al. | 53/413 X |
| 5,632,132 | 5/1997 | Kuipers et al. | 53/134.2 X |
| 5,689,936 | 11/1997 | Kenney | 53/134.2 X |

FOREIGN PATENT DOCUMENTS

| | | |
|---|---|---|
| 448 325 | 9/1991 | European Pat. Off. . |
| 489 554 | 6/1992 | European Pat. Off. . |
| WO 92/14649 | 9/1992 | WIPO . |
| WO 94/06685 | 3/1994 | WIPO . |
| WO 94/22721 | 10/1994 | WIPO . |
| WO 95/10462 | 4/1995 | WIPO . |

*Primary Examiner*—Daniel B. Moon
*Attorney, Agent, or Firm*—James J. Farrell

[57] ABSTRACT

A method and apparatus are provided for assembling together tags (6), thread (8) and a web of envelope material for producing tagged packets. The tags are held on spaced seats on the periphery of a rotary carrier (2) and the thread is laid over the carrier and the tags. It is formed into a convoluted shape on the peripheral surface of the carrier between the tags by laterally displaceable holding pins (12) or by being dispensed onto the carrier by a displaceable guide (50). The web is brought against the tags and thread and attached to them maintaining the convoluted pattern of the thread. The assembly of web, thread and tags is suitable for a subsequent form-filling operation to complete the packets.

15 Claims, 4 Drawing Sheets

METHOD AND APPARATUS FOR THE PRODUCTION OF TAGGED PACKETS

Figure 1:
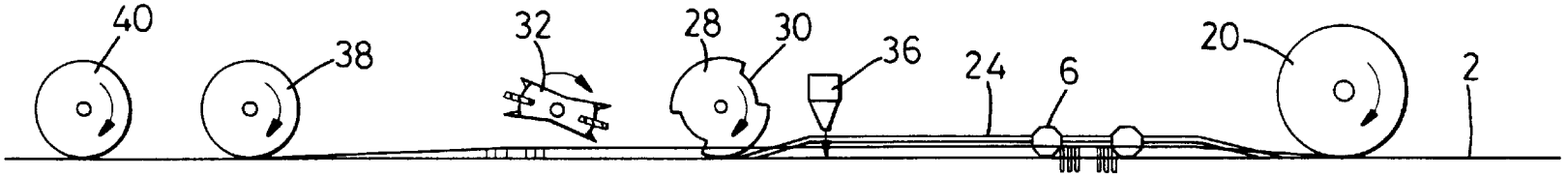

This invention relates to a method and apparatus for producing packets containing a flowable material, for example a material such as tea or coffee which is to be infused by immersing the packet. The invention is also concerned with the provision of packets provided with a tag on the end of a thread from which the packet can be suspended.

Such tagged packets are well known as infusion packets, the tag providing a convenient means of retrieving the wetted packet. In many instances, measures are taken to ensure that the tag and/or loops of thread do not hang loose from such packets as there is a risk of entanglement if a number of such packets are packaged together. This problem is accentuated by the fact that it is generally desirable to provide a relatively long length of connecting thread between the tag and the packet.

To reduce the risk of entanglement with such long threads, in some proposals the thread is looped around the packet, while in others, a thread loop is held between the tag and the packet. Examples of both types are shown in U.S. Pat. No. 5,312,318. In still other proposals, the thread is retained inside the packet.

In most instances these arrangements make the production of the packets slow and complicated. It is true that arrangements such as are described in U.S. Pat. No. 5,580,408 and U.S. Pat. No. 5,339,224, in which the tag overlies a looped thread, can be formed in a continuous process that can be operated relatively rapidly but the control of the thread loops is difficult before they are finally held between the tags and the packet web and the design of the packets must therefore allow some latitude for the variations that occur. Continuous processes are also known from U.S. Pat. No. 5,312,318 and U.S. Pat. No. 5,632,132 in which the thread is looped around the packet but the length of thread may then be more than is required for some purposes.

In one aspect of the present invention, a method is provided for producing tagged packets in which a series of tags is located in spaced relation on a displaceable carrier, a thread is laid over the tags and in lengths of thread between adjacent pairs of tags are formed into a convoluted pattern substantially co-planar with adjacent tags of the series, the tags being secured to the thread and a web of a packet material being attached to the thread and tags.

The reference to the thread being substantially coplanar to adjacent tags is intended to include the instance in which the tags are located in a linearly spaced relation on the circular or polygonal periphery of a rotary carrier and the thread is laid on said periphery of the carrier over the tags.

In one form of the method according to the invention, the thread may be drawn out into said convoluted pattern after being laid over the tags, conveniently in the inter-tag spaces adjacent each tag. In another form of the method, the thread is laid onto the carrier in said convoluted pattern, and extends over the tags.

Preferably the thread is attached to the tags by glue or heat sealing means, eg. folding the tags over the thread and then adhering them thereto, while the tags are held on said carrier.

According to another aspect of the invention, apparatus is provided for producing tagged packets and comprising a displaceable carrier having a face or faces on which a series of seats for individual tags are spaced apart in the direction of displacement, and there are means for laying a thread on the carrier along a path extending over the tags, between pairs of said seats there being holding elements on said face or faces for locating the thread in a convoluted pattern, the apparatus further comprising means for securing the thread to the tags, means for applying a web of packet material to the tags and thread on said carrier face or faces and for attaching said web to them.

In one form of such apparatus, for carrying out the method of the invention, the holding elements project from the carrier to engage the thread, and means are provided for the movement of at least one of said elements laterally to the thread path to spread the thread in its convoluted pattern on the carrier between the tags.

Another form of apparatus according to the invention comprises a dispensing guide through which thread is fed to the carrier and means are provided for moving said guide on a path that passes the holding elements on the carrier to deploy the thread onto said elements for it to be held in said convoluted pattern by said elements. Preferably means are also provided to maintain the thread in tension while it is being deployed in said convoluted form so that the shape of the convolutions are determined by said holding means.

In a further aspect of the invention, a tagged packet is provided in which a thread located on an outer face of the packet has opposite ends secured to the tag and the packet and the remainder of the thread between said ends is releasably attached in a convoluted form to said packet face away from the tag.

In yet another aspect of the invention, a tagged packet is provided in which the contents of the packet are enclosed between opposite end seals across the body of the packet material, said end seals being formed in mutually transverse directions, and in which a thread located on an outer face of the packet is secured at opposite ends to the tag and to an end edge of the packet at one of said end seals and is releasably attached in a convoluted form to said face of the packet between said tag and said end edge.

Figure 2:
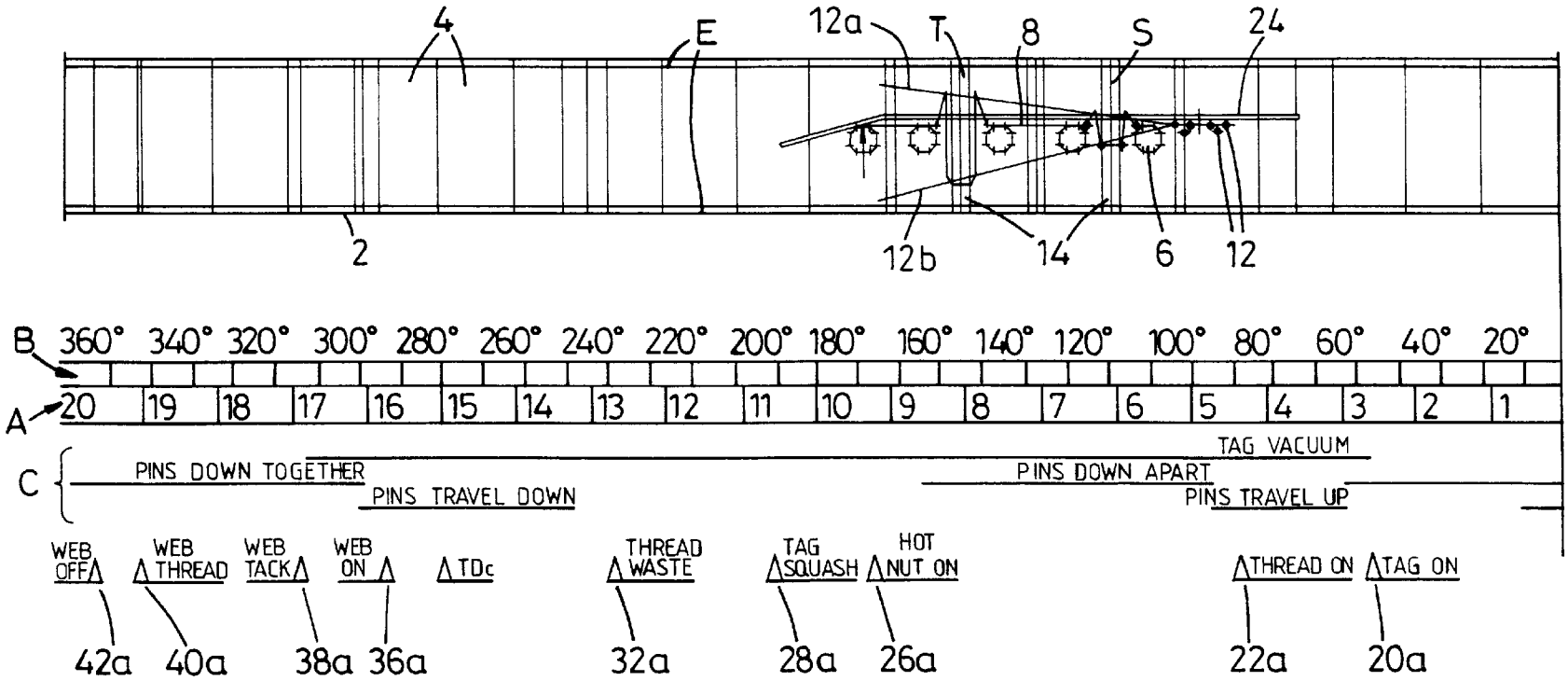
Figure 3:
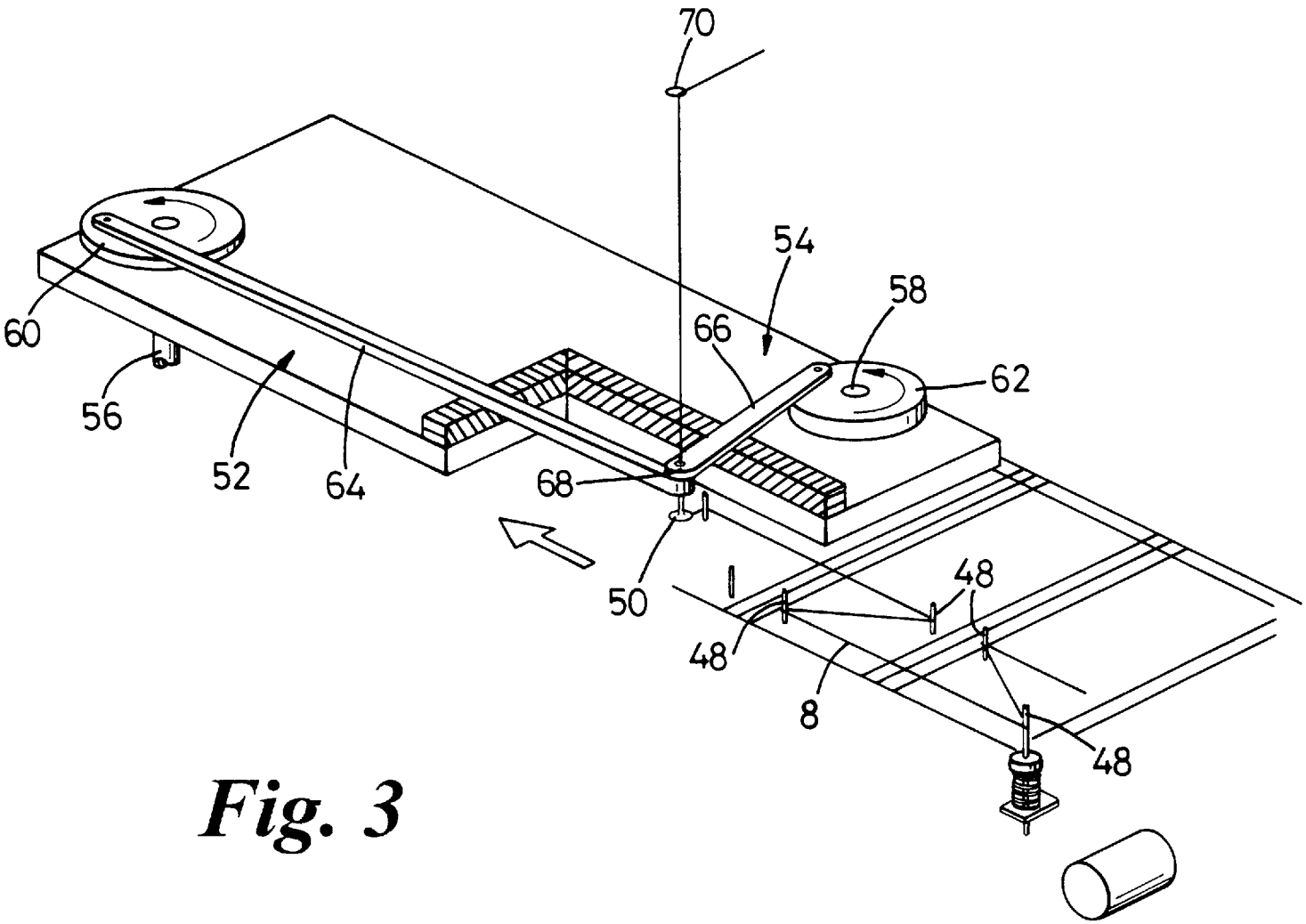
Figure 4A:
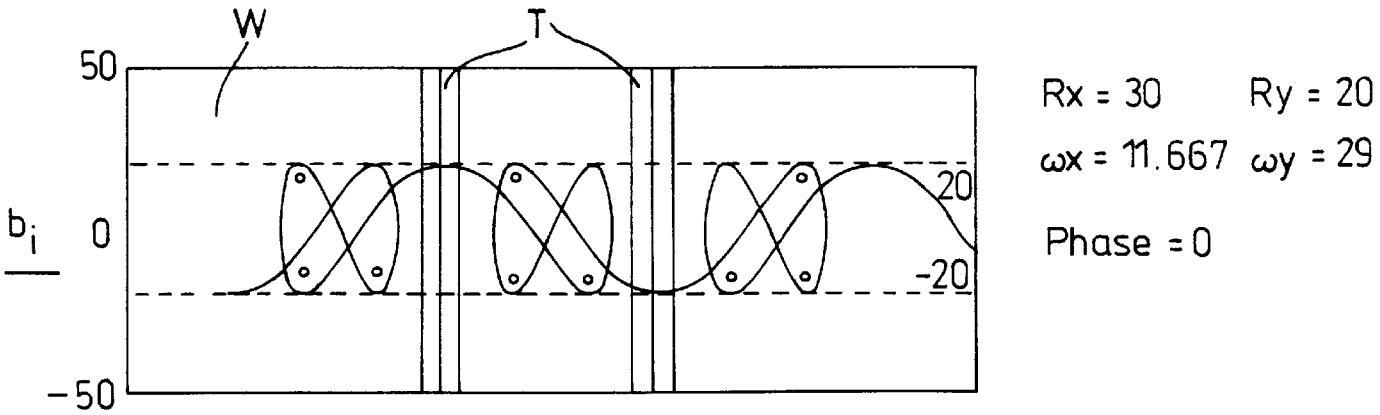
Figure 4B:
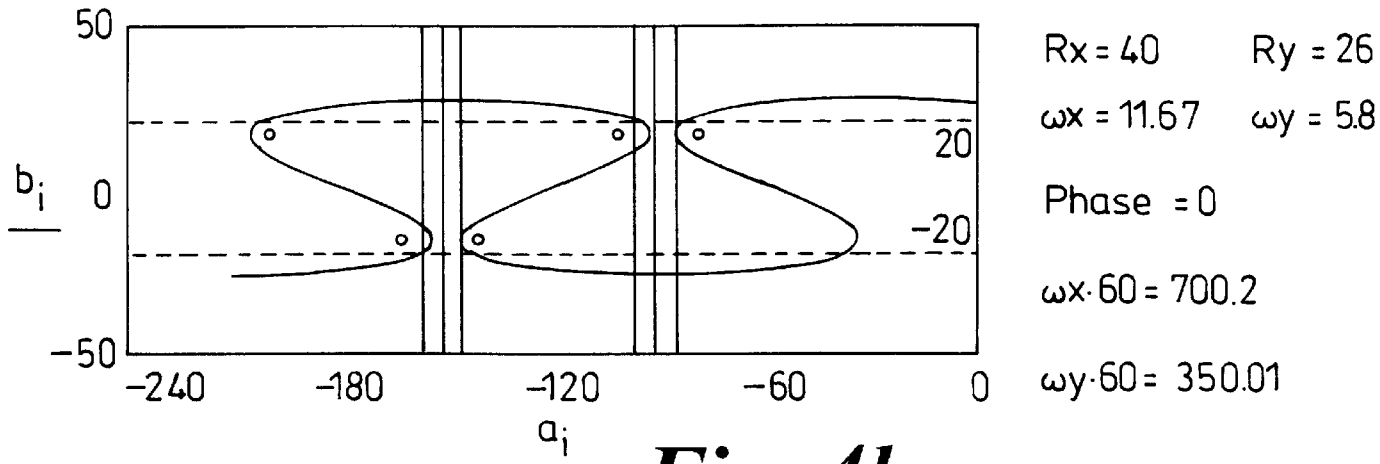
Figure 5:
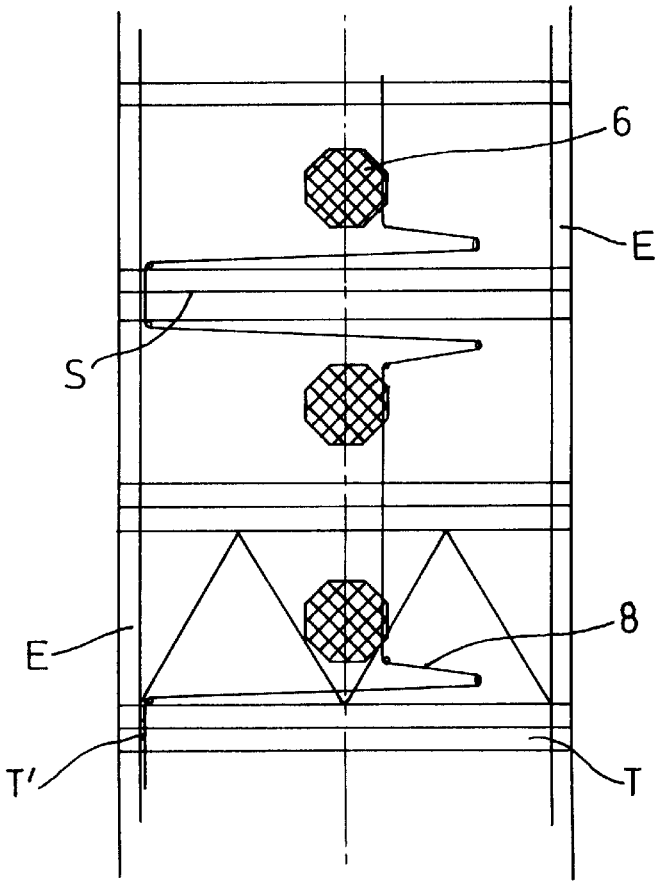
Figure 6:
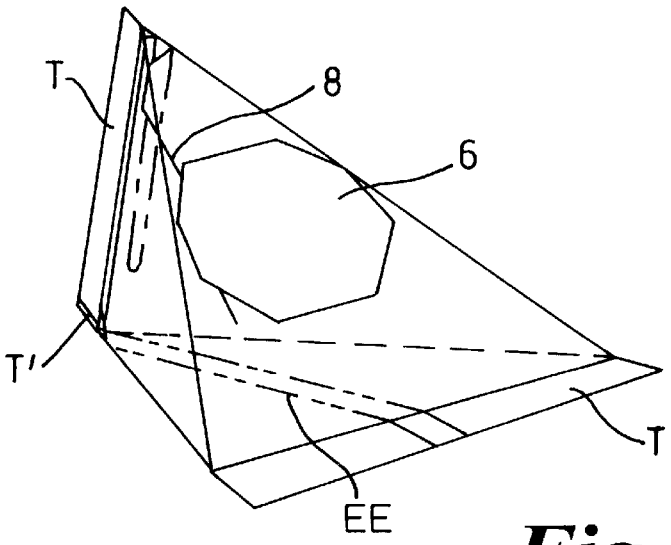

The invention will be further described by way of example with reference to the accompanying schematic drawings, in which:

FIGS. 1 and 2 are illustrations in mutually perpendicular directions of an apparatus according to the invention, FIG. 3 is an oblique view of part of another apparatus according to the invention, FIGS. 4*a* and 4*b* are graphical representations of two alternative thread patterns that can be produced by the apparatus of FIG. 3, FIG. 5 illustrates a web carrying the completed thread pattern produced in the apparatus of FIGS. 1 and 2, and FIG. 6 is an oblique view of the packet formed from the web of FIG. 5.

FIGS. 1 and 2 comprise developed views of a rotary drum 2 that forms part of the first embodiment, FIG. 1 being a view from the side of the drum and FIG. 2 being a view radially onto the drum. On the circular periphery of the drum are a series of twenty seats 4, also indicated in the scale A in the lower part of FIG. 2, provided with suction means (not shown) to retain respective tags 6 on the seats. As angular scale B indicates, the seats extend around the entire 360° of the drum periphery. An analogous form of drum is illustrated in patent U.S. Pat No. 5,632,132 which also shows the means for placing separate tags from a tag strip on the suction seats. As in that earlier example, the tags are intended to be folded double and the tag profiles shown in FIGS. 1 and 2 are of a half-tab only, to one side of the fold line. Also as in that earlier example, a thread 8 is laid onto the periphery of the drum on an initially straight path, over the tags.

Pins 12 project radially from the surface of the drum in alternate spaces 14 between the tags. In each such space 14 there are two pairs of three pins, one pair on one side of the thread path and the third on the other side. A cam mechanism is provided within the drum for moving some of the pins axially of the drum, ie. laterally to the thread path, and all the pins radially. The progressive axial displacement of the pins is indicated in FIG. 2 by the divergent paths 12*a*, 12*b*.

The sequence of operations performed by mechanisms on or adjacent the drum 2 are identified by the indications C in FIG. 2, and the lines associated with these indications show their timing and duration against the angular scale B. These and further steps of the process also shown in FIG. 2, as well as the apparatus for performing the process, will now be described in more detail.

In FIG. 1 in particular are illustrated a number of devices disposed at fixed positions around the periphery of the drum to act on the tags 6 and thread 8. The tag transfer roller 20 that places the tag on the suction seats of the drum is a small distance upstream of the point at which the thread reaches the drum, the angular positions of these two steps being indicated by the station markers 20*a*, 22*a* in FIG. 2. Immediately before the point at which the thread is laid upon each tag, however, a fixed plough 24 close to the drum periphery has begun to bend the tag about its fold line, bringing one half of the tag substantially upright as indicated in FIG. 1.

The thread 8 is thus located laterally by the pins 12 and by the upright portions of the tags 6 shortly after it reaches the drum. The cam mechanism (not shown) for the pins comprises two fixed tracks within the drum, one controlling the movement of the pins radially into and out of the drum surface, and the other controlling the movement of the pins laterally of the surface. When the thread reaches the drum the pins are already raised above its surface and under the influence of the second cam track two of each group of three pins then begin to be displaced laterally, as indicated in FIG. 2, to draw the thread on the drum surface into a convoluted pattern. As the lateral movement of the pins is completed, between each pair of tabs a hot melt gun 36 dispenses glue onto the thread (station marker 26*a*), and the exit end of the plough 24 completes the folding of the tag. A roller 28 immediately following the plough applies pressure to the folded tags (station marker 28*a*) to spread the glue and secure the bond.

The roller 28 has clearance recesses 30 to allow the pins to remain raised during this stage. The pins 12 also remain raised during the following stage (station marker 32*a*) where a cutter rotor 32 severs the portions of thread extending over the alternate inter-tag spaces from which the pins are absent. Because they have been glued to the tags, which are still held in place by suction, the remaining thread portions are kept in their convoluted pattern around the pins, subject to a small tension force.

A web W (not shown in FIGS. 1 and 2) intended to form the envelope of the packets is now brought onto the drum (station marker 36*a*) over the tags and thread. The pins are retracted as the thread is frictionally engaged by the web and a heat sealing roller 38 applies tacking welds between the web and the tags (station marker 38*a*). A second heat sealing roller 40 applies further tack welds (station marker 40*a*) to complete the attachment of tags and thread to the web. The assembly of web, tags and thread is then drawn off the drum (station marker 42*a*). It is alternatively possible to arrange that the pins are not fully retracted until tack welding has been completed but can yield to the rollers 38,40 by mounting them in a spring-loaded manner.

FIG. 3 illustrates an alternative apparatus for deploying the thread over the tags 6 on the periphery of a similar rotary drum and on which they are held in the manner already described. The thread 8 is held by similar pins 48 projecting from the surface of the drum but in this instance the pin lateral positions are fixed, although they can still be retracted into the drum surface. The other features of the apparatus not shown in FIG. 3 may be the same as those described with reference to FIGS. 1 and 2.

The thread is now deployed onto the drum through a tubular guide 50 which moves in a closed loop over the surface of the drum, under the control of two crank mechanisms 52,54, comprising respective rotary drive shafts 56,58 carrying cranks 60,62. The end of a respective connecting rod 64,66 is pivoted to each crank at a radius from its drive shaft axis. The further ends of the two rods 64,66 are interconnected by a pin joint 68 coaxial with the tubular thread guide 50. The thread is led from its bobbin through a fixed guide 70 under a substantially constant tension and is deployed by the tubular guide onto the rotary drum. The connecting rods extend generally transversely to each other, the mean position of the rod 64 being in the direction of movement of the adjacent surface of the drum and the mean position of the rod 66 being perpendicular to that direction.

The path of the tubular guide is determined by the rotary speeds of the two drive shafts, the radius of each crank pivot from its drive shaft axis and the phase difference, if any, between the two cranks. As the speeds of rotation and crank radii vary relative to each other in the two mechanisms, or the phase difference between the two mechanism is changed, the path of the tubular thread guide is varied.

To deploy the thread on the web W in the pattern shown in FIG. 3, the conditions illustrated in FIG. 4*a* are appropriate. That is to say, the mechanism with the connecting rod 64 has a crank radius of 40 mm and a speed of rotation of 700 rpm while the connecting rod 66 has a crank radius of 26 mm and a speed of 350 rpm. The two mechanisms are at the same phase.

FIG. 4*b* illustrates an alternative thread pattern that can be produced if the first mechanism has a crank pivot radius of 30 mm and is rotated at 700 rpm while the second mechanism has a crank pivot radius of 20 mm and is rotated at 1750 rpm, the two mechanisms again being in phase with each other.

It is of course not necessary for the path of the guide 50 to correspond exactly with the required thread pattern. If a small tension is maintained in the thread as the guide traces its path, on the thread will be drawn against the pins and tags to determine its final pattern.

FIGS. 4*a* and 4*b* indicate the web W and the relationship of the thread pattern to transverse seals T which define the boundaries between successive packets. The tags 6 are not shown, but as in FIG. 2 they may be located mid-way between the seals T.

The assembly of web, thread and tag produced by either of the examples described above may be processed to form individual packets in a number of different ways. In the present instance, however, the web is used in a form-fill process in which, with the tags and thread attached, the opposite side edges E are brought together on a tubular former and sealed along a longitudinal seam EE (FIG. 6) to give a closed tube which is sealed transversely at intervals as filling material is dropped into it, and then severed at the transverse seals to produce a series of separate filled packets. This process which is also described in U.S. Pat. No. 5,632,132, may be carried out in a generally conventional manner. The transverse seal positions, and the lines of severance in the web are indicated by the references T and S respectively in FIGS. 2 and 4 in their relation to the thread pattern although they are formed only at a later stage in the process.

FIG. 5 shows web W carrying the tags 6 and completed pattern of the thread 8 which FIG. 2 shows being formed. In the formation of the completed packet, shown in FIG. 6, successive transverse seals T are made transversely to each other, so that the packet has a tetrahedral-like shape. The shape is shown with sharply delineated facet edge to clarify the relationship between FIGS. 5 and 6, but the web will not normally be creased at these edges.

Where the thread crosses the transverse seals T, it now does so at T', close to or at the longitudinal seam EE, so that in each individual packet the thread extends from a corner of the packet. In use, therefore, this corner is uppermost when the packet is suspended from its tag.

It will be clear that the thread patterns shown in FIGS. 2 and 4 are but a few illustrative examples and a wide variety of thread patterns can be produced by the means and method described.

It will be understood that the tags may be of single thickness rather than the doubled-over tags described in the example of FIG. 2. Also, the attachment of the thread to the tags can be by the use of thermoplastic materials in the tags and/or the thread instead of glue if desired.

We claim:

1. A method of producing tagged packets in which a series of tags is located on a displaceable carrier in spaced relation in a direction of displacement of the carrier, spaces being formed thereby on the carrier between successive tags, a thread is laid onto the carrier to extend over the tags and spaces, and lengths of the thread in at least some of said spaces are formed in a convoluted pattern, said tags being secured to the further lengths of the thread extending over the tags and a web of a packet material being attached to the thread and tags.

2. A method according to claim 1 wherein the thread is drawn out into said convoluted pattern after being laid onto the carrier to extend over the tags.

3. A method according to claim 1 wherein the convoluted pattern thread lengths are formed as they are laid onto the carrier in said convoluted pattern to extend over the tags in a meandering path.

4. A method to claim 1 wherein the tags engage and locate said further lengths of the thread in the formation of said convoluted pattern thread lengths.

5. A method according to claim 1 wherein said further lengths of the thread are secured to the tags by folding the tags over the thread and adhering the folded parts of each tag together while the tags are held on the carrier.

6. A method according to claim 1 wherein said convoluted thread pattern thread lengths are formed in alternate said spaces to be associated with the pairs of tags at opposite sides of said alternate spaces.

7. A method according to claim 6 wherein, after the tags are secured to the thread, lengths of the thread in the spaces between said alternate spaces are removed while the tags are held in their locations on the carrier to maintain said convoluted pattern thread lengths in their formed state.

8. A method according to claim 1 in which the web with the attached thread and tags is given a tubular shape around a hollow cylindrical form and its side edges sealed together in a form-fill process for filling and separating the packets, the tags being substantially diametrically opposite said sealed side edges in the tubular shape.

9. Apparatus for producing tagged packets comprising a displaceable carrier having a face or faces on which a series of seats for individual tags and spaces between successive seats are located in linear relation in a direction of displacement of the carrier, and a thread laying mechanism for laying a thread on the carrier along a path extending over the tags and said spaces, holding elements being disposed on the carrier in at least some of the spaces between the tag seats for locating the thread in a convoluted pattern in said spaces, the apparatus further comprising securing means for attaching the thread to the tags, and a web handling arrangement for applying a web of packet material to the tags and thread on said carrier face or faces and for attaching said web to them.

10. Apparatus according to claim 9 wherein the holding elements project from the carrier to engage the thread, and means are provided for the movement of at least one of said elements laterally to the thread path to spread the thread in its convoluted pattern on the carrier in said spaces between the seats.

11. Apparatus according to claim 9 comprising a dispensing guide through which the thread is fed to the carrier, means for moving said dispensing guide on a path that passes the holding elements on the carrier to deploy the thread onto said elements for it to be held in said convoluted pattern by said elements.

12. Apparatus according to claim 11 wherein means are provided to maintain the thread in tension while it is being deployed so as to draw it into said convoluted pattern against the holding elements.

13. Apparatus according to claim 9 wherein the holding elements are disposed in alternate spaces between tag seats and thread severing means are provided for removal of portions of the thread in the remaining spaces between tag seats after the thread has been attached to the tags.

14. A method of producing tagged packets in which a series of tags is located on a displaceable carrier in spaced relation in a direction of displacement of the carrier, a thread is laid over the tags and the inter-tag spaces on the carrier, and lengths of the thread in alternate inter-tag spaces are formed in a convoluted pattern to be associated with the pairs of tags on opposite sides of said alternate spaces, said tags being secured to the thread and a web of a packet material being attached to the thread and tags.

15. Apparatus for producing tagged packets comprising a displaceable carrier having a face or faces on which a series of seats for individual tags and spaces between successive seats are located in linear relation in a direction of displacement of the carrier, and a thread-laying mechanism for laying a thread on the carrier along a path extending over the tags and the spaces, holding elements being disposed on the carrier in alternate said spaces between the seats for locating the thread in a convoluted pattern, the apparatus further comprising means for attaching the thread to the tags, a device for removal of portions of the thread in the remaining spaces between tag seats after the thread has been attached to the tags, and a web handling arrangement for applying a web of packet material to the tags and thread on said carrier face or faces and for attaching said web to them.

* * * * *